United States Patent [19]

Flaig et al.

[11] Patent Number: 4,947,807

[45] Date of Patent: Aug. 14, 1990

[54] INTERNAL COMBUSTION ENGINE

[75] Inventors: John D. Flaig, Libertyville; Gene F. Baltz, Lake Villa; Henry C. Billingsley; David H. Hartke, both of Waukegen; James A. Holcomb, Wildwood; Chester G. DuBois, Zion, all of Ill.; Dale L. Taipale, Delafield, Wis.

[73] Assignee: Outboard Marine Corporation, Waukegan, Ill.

[21] Appl. No.: 188,952

[22] Filed: May 2, 1988

Related U.S. Application Data

[60] Division of Ser. No. 742,583, Jun. 7, 1985, Pat. No. 4,757,792, which is a continuation-in-part of Ser. No. 728,145, Apr. 29, 1985, abandoned, which is a continuation of Ser. No. 508,941, Jun. 29, 1983, abandoned.

[51] Int. Cl.[5] ..... F02B 13/00

[52] U.S. Cl. ..... 123/52 MV; 123/73 A; 123/579; 123/55 VF

[58] Field of Search ..... 123/579, 583, 52 M, 123/52 MV, 73 A, 73 PP, 59 PC, 55 VS, 55 VF, 59 B, 55 R, 65 R; 261/23.2, 72.1, 70, 68, 34.1

[56] References Cited

U.S. PATENT DOCUMENTS

| | | | |
|---|---|---|---|
| 2,323,442 | 7/1943 | Beard | 123/579 |
| 2,473,761 | 6/1949 | Mallory | 123/437 |
| 2,630,791 | 3/1953 | Kiekhaefer | 123/579 |
| 2,744,736 | 5/1956 | Evinrude | 261/72.1 |
| 3,051,631 | 12/1973 | Kiekhaefer | 123/73 A |
| 3,100,236 | 8/1963 | Ott et al. | 261/34.2 |
| 3,104,272 | 9/1963 | Carlson et al. . | |
| 3,105,861 | 10/1963 | Korte | 261/34.2 |
| 3,109,043 | 10/1963 | Carlson et al. . | |
| 3,136,827 | 6/1964 | Szwargulski | 261/72.1 |
| 3,138,646 | 6/1984 | Miles, Jr. et al. . | |
| 3,166,054 | 1/1965 | Conover . | |
| 3,166,611 | 1/1965 | Conant et al. . | |
| 3,269,374 | 8/1966 | Conover . | |
| 3,288,446 | 11/1966 | Bimberg | 261/68 |
| 3,313,532 | 4/1967 | Carlson et al. . | |
| 3,321,195 | 5/1967 | Korte . | |
| 3,416,845 | 12/1968 | Scanland . | |
| 3,544,083 | 12/1970 | Currie . | |
| 3,561,736 | 2/1971 | Owne Dye . | |
| 3,575,390 | 4/1971 | Bickhaus . | |
| 3,759,493 | 9/1973 | Blanchard et al. . | |
| 3,825,238 | 7/1974 | Nishihara et al. | 261/72 |
| 4,016,838 | 4/1977 | Yoshioka et al. | 123/579 |
| 4,244,332 | 1/1981 | Kusche et al. | 123/59 B |
| 4,261,305 | 4/1981 | Ikoma | 123/59 B |
| 4,263,882 | 4/1981 | Tezuka et al. | 261/23 A |
| 4,266,514 | 5/1981 | Tyner | 123/59 B |
| 4,333,425 | 6/1982 | Kusche | 123/73 A |
| 4,345,551 | 8/1982 | Bloemers | 123/59 B |
| 4,556,032 | 12/1985 | Miller | 261/34.1 |

FOREIGN PATENT DOCUMENTS

| | | |
|---|---|---|
| 55-64125 | 5/1980 | Japan . |
| 55-96347 | 7/1980 | Japan . |
| 57-20542 | 2/1982 | Japan . |
| 59-559 | 1/1984 | Japan . |
| 59-160062 | 9/1984 | Japan . |

OTHER PUBLICATIONS

Evinrude Service Manual 1976; Outboard Marine Corporation 1975; pp. 5–6 and 5–7 (no months provided).

*Primary Examiner*—David A. Okonsky

*Attorney, Agent, or Firm*—Michael, Best & Friedrich

[57] ABSTRACT

An internal combustion engine comprising a crankcase adapted to rotatably support a crankshaft having an axis, the crankcase defining a plurality of crankcase chambers and including a generally flat manifold mounting surface including therein a first series of inlet openings aligned in the direction of the crankshaft axis, and a second series of inlet openings aligned in the direction of the crankshaft axis, the first and second series being laterally offset with respect to the direction of the crankshaft axis, and each of the inlet openings of the first and second series being respectively adapted to feed air to one of the crankcase chambers and having a minor dimension parallel to the crankshaft axis, a major dimension transverse to the crankshaft axis, and a portion overlapping the inlet openings of the other of the first and second series.

26 Claims, 8 Drawing Sheets

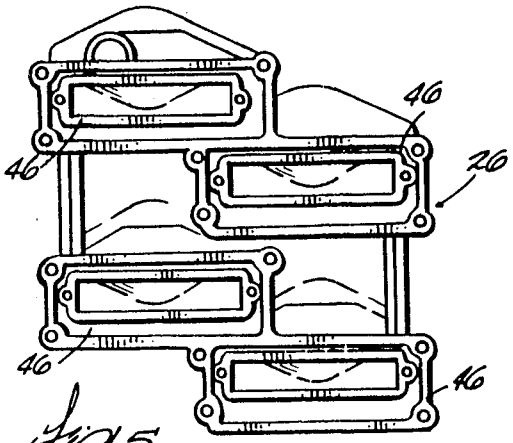
FIG. 5
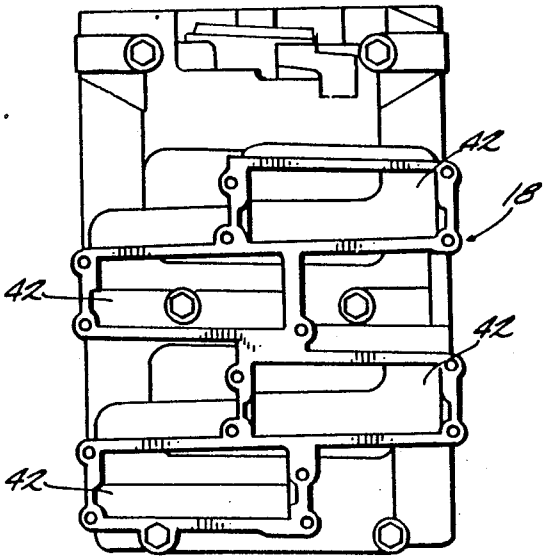
FIG. 8
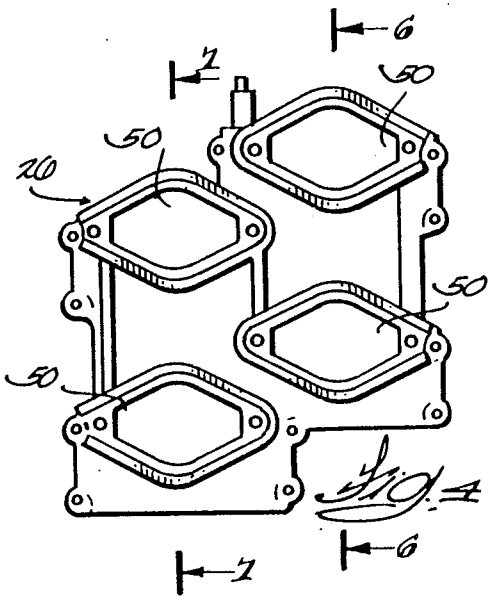
FIG. 4
FIG. 7
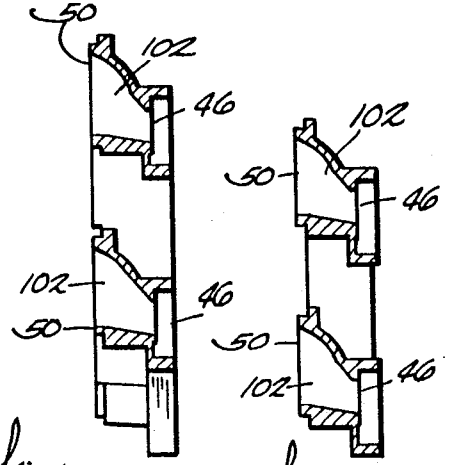
FIG. 6
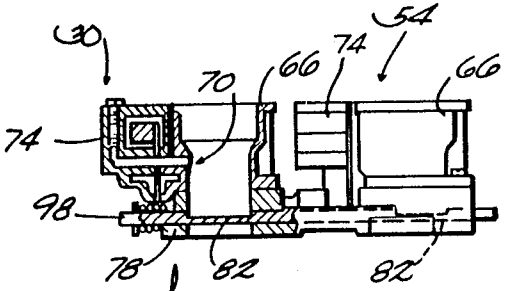
FIG. 10
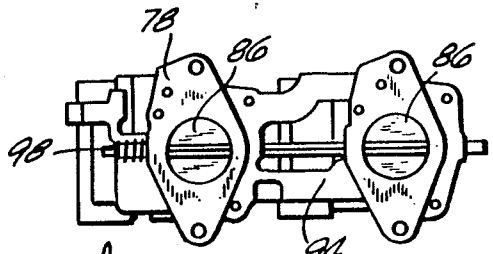
FIG. 3

INTERNAL COMBUSTION ENGINE

RELATED APPLICATION

This application is a division of Application Ser. No. 742,583, filed June 7, 1985, and now U.S. Pat. No. 4,757,792, which is a continuation-in-part of U.S. Baltz, et al. Application Ser. No. 728,145, filed Apr. 29, 1985, abandoned, which is a continuation of Application Ser. No. 508,941, filed June 29, 1983, abandoned.

BACKGROUND OF THE INVENTION

This invention relates to internal combustion engines and, more particularly, to carburetion systems for internal combustion engines, and to engine block, crankcase, and intake manifold constructions for internal combustion engines.

Attention is directed to the following U.S. patents which disclose internal combustion engines and/or carburetors:

Conover; 3,166,054 Jan. 19, 1965
Conover; 3,269,374 Aug. 30, 1966
Blanchard; 3,759,493 Sept. 18, 1973
Kiekhaefer; 3,851,631 Dec. 3, 1974
Kusche; 4,244,332 Jan. 13, 1981
Ikoma; 4,261,305 Apr. 14, 1981
Tyner; 4,266,514 May 12, 1981
Miles; 3,138,646 June 23, 1964
Korte; 3,105,861 Oct. 1, 1963
Currie; 3,544,083 Dec. 1, 1970
Dye; 3,561,736 Feb. 9, 1971
Carlson; 3,109,043 Oct. 29, 1963
Yoshioka; 4,016,838 Apr. 12, 1977
Kieknaefer; 2,630,791 Mar. 10, 1953
Bickhaus; 3,575,390 Apr. 20, 1971
Carlson; 3,104,272 Sep. 17, 1963
Conant; 3,166,611 Jan. 19, 1965
Carlson; 3,313,532 Apr. 11, 1967
Korte; 3,321,195 May 23, 1967
Scanland; 3,416,845 Dec. 17, 1968

SUMMARY OF THE INVENTION

The invention provides an internal combustion engine comprising a crankcase adapted to rotatably support a crankshaft having an axis, the crankcase including a generally flat manifold mounting surface including therein a first series of inlet openings aligned in the direction of the crankshaft axis and a second series of inlet openings aligned in the direction of the crankshaft axis, the inlet openings of the first and second series being in alternating laterally offset relation with each other in respect to the direction of the crankshaft axis, and the inlet openings being adapted to feed air to the crankcase and each having a minor dimension parallel to the crankshaft axis and a major dimension transverse to the crankshaft axis.

The invention also provides an intake manifold adapted to be connected to a crankcase adapted to rotatably support a crankshaft having an axis, the intake manifold comprising a first series of intake passages aligned in the direction of the crankshaft axis, and a second series of intake passages aligned in the direction of the crankshaft axis, the intake passages of the first and second series being in alternating laterally offset relation with each other in respect to the direction of the crankshaft axis, the passages of the first and second series extending in substantially parallel relation to one another, and each including an outlet having a minor dimension parallel to the crankshaft axis and a major dimension transverse to the crankshaft axis and being adapted to feed air to the crankcase.

The invention also provides an internal combustion engine including first and second cylinders, a crankshaft, a crankcase connected to the first and second cylinders, rotatably supporting the crankshaft, and including first and second inlet openings aligned in the direction of the crankshaft, a throttle body housing member fixed to the crankcase and including spaced first and second throttle body openings communicating with the first and second inlet openings, a first carburetor body attached to the throttle body housing member, a second carburetor body attached to the throttle body housing, a throttle shaft rotatably mounted by the throttle body housing member and having a first portion located in the first throttle body opening and a second portion located in the second throttle body opening, and first and second throttle valves mounted respectively on the first and second portions of the throttle shaft.

The invention also provides an internal combustion engine comprising a crankcase adapted to rotatably support a crankshaft having an axis, the crankcase including a generally flat manifold mounting surface including therein a first series of inlet openings aligned in the direction of the crankshaft axis, and a second series of inlet openings aligned in the direction of the crankshaft axis and in laterally offset relation to the first series of inlet openings, an intake manifold including a generally flat crankcase mounting surface connected to the mounting surface of the crankcase, a generally flat carburetor mounting surface extending in spaced generally parallel relation to the crankcase mounting surface, a first series of passages extending between the crankcase and carburetor mounting surfaces and respectively communicating with the first series of inlet openings and a second series of passages extending between the crankcase and carburetor mounting surfaces and respectively communicating with the second series of inlet openings, a first throttle body housing member fixed to the carburetor mounting surface and including a first series of tnrottle body openings respectively communicating with the first series of passages, a first series of carburetor bodies attached to the first throttle body housing member and respectively communicating with the first series of throttle body openings, a first throttle shaft rotatably mounted by the first throttle body housing member and having a first series of portions respectively located in the first series of throttle body openings, a second throttle body housing member fixed to the carburetor mounting surface and including a second series of throttle body openings respectively communicating with the second series of passages, a second series of carburetor bodies attached to the second throttle body housing member and respectively communicating with the second series of throttle body openings, and a second throttle shaft rotatably mounted be the second throttle body housing member and having a second series of portions respectively located in said second series of throttle body openings.

The invention also provides an internal combustion engine comprising a crankcase adapted to rotatably support a crankshaft having an axis, the crankcase defining first and second generally cylindrical crankcase chambers aligned in the direction of the crankshaft axis, a first cylinder having a longitudinal axis intersecting the crankshaft axis, a second cylinder having a longitudinal axis at a substantial angle to the first cylinder axis and intersecting the crankshaft axis, the first and second cylinders respectively communicating with the first and second crankcase chambers through respective first and second cylinder openings in the crankcase, and a generally flat manifold mounting surface generally perpendicular to a line bisecting the first and second axes, the mounting surface including first and second inlet openings respectively communicating with the first and second crankcase chambers through respective entry openings in the crankcase located in respectively generally diametrically opposite relation to the first and second cylinder openings.

The invention also provides an internal combustion engine comprising a crankcase adapted to rotatably support a crankshaft having an axis, the crankcase and defining a plurality of generally cylindrical crankcase chambers aligned in the direction of the crankshaft axis, a first series of cylinders having parallel longitudinal axes defining a first plane including the crankshaft axis, a second series of cylinders having parallel longitudinal axes defining a second plane at a substantial angle to the first plane and including the crankshaft axis, each of the cylinders of the first and second series communicating with an associated crankcase chamber through a cylinder opening in the crankcase, and a generally flat manifold mounting surface generally perpendicular to a plane bisecting the first and second planes, the mounting surface including a plurality of inlet openings respectively communicating with the crankcase chambers through respective entry openings in the crankcase located in respectively generally diametrically opposite relation to the cylinder openings.

The invention also provides a carburetor comprising a throttle body section having a first end, an opposite second end including a generally flat mounting surface, and a first portion of an air passage extending between the first end and the mounting surface, a venturi section mounted on the mounting surface of the tnrottle body section and including a second portion of the air passage, and a generally flat mounting surface transverse to the mounting surface of the throttle body section, a float bowl section mounted on the mounting surface of the venturi section and including a generally flat surface abutting the mounting surface of the venturi section, and a reservoir including a float chamber, a throttle shaft rotatably mounted in the tnrottle body section and extending through the air passage first portion, a throttle plate mounted on the throttle shaft in the air passage first portion, and conduit means communicating between the air passage second portion and the reservoir.

In one embodiment, the mounting surface of the venturi section is generally horizontal and faces downwardly, the float bowl section is generally cup-shaped and has an upper end forming the generally flat surface of the float bowl section, and the conduit means extends generally vertically between the reservoir and the air passage second portion.

In one embodiment, the throttle body section is made of metal, and the venturi section and the float bowl section are made of plastic.

In one embodiment, the throttle body section, the venturi section, and the float bowl section are made of plastic.

In one embodiment, the reservoir further includes a well communicating with the float chamber, and the carburetor further comprises a conduit communicating between the air passage first portion and the well.

In one embodiment, the conduit means includes a nozzle mounted in the venturi section and having a first end communicating with the air passage second portion, and a second end extending beyond the mounting surface of the venturi section into the reservoir.

A principal feature of the invention is the provision of an internal combustion engine comprising, in part, a crankcase defining first and second generally cylindrical crankcase chambers, first and second cylinders respectively communicating with the first and second crankcase chambers through respective first and second cylinder openings in the crankcase, and a generally flat manifold mounting surface including first and second inlet openings respectively communicating for first and second crankcase chambers through respective entry openings in the crankcase located in respectively generally diametrically opposite relation to the first and second cylinder openings. Because the entry openings are generally diametrically opposite the cylinder openings, inlet air flow to the cylinders is maximized, thereby maximizing engine power.

Another principal feature of the invention is the provision of a carburetor comprising, in part, a tnrottle body section including a generally flat mounting surface and a first portion of an air passage, a venturi section mounted on the mounting surface of the throttle body section and including a second portion of the air passage and a generally flat mounting surface transverse to the mounting surface of the throttle body section, and a float bowl section mounted on the mounting surface of the venturi section and including a generally flat surface abutting the mounting surface of the venturi section. This construction simplifies manufacturing of the carburetor.

Another principal feature of the invention is the provision of a carburetion system which is more effective and practical than past carburetion systems by virtue of the carburetion system including coaxial tnrottle shaft portions connected for common rotational movement.

Another principal feature of the invention is the provision of such a carburetion system which includes throttle shaft portions aligned with the crankshaft to thereby limit the amount of linkage necessary in order to connect the throttle shaft portions to a timer base provided for rotating the tnrottle shaft portions.

Another principal feature of the invention is the provision of an intake manifold including generally parallel air passageways therein which provide for movement in the same general direction of the air through the passageways. When the air passes through the passageways in a horizontal or downwardly inclined fashion, the intake manifold assists in providing a more effective carburetion system by reducing the need for the air to flow against gravity.

Other features and advantages of embodiments of the invention will become apparent upon reviewing the following drawings, detailed description, and claims.

BRIEF DESCRIPTION OF THE DRAWINGS

FIG. 2 is a side view of a set of carburetor assemblies.

FIG. 3 is a rear view of the set of carburetor assemblies shown in FIG. 2.

FIG. 4 is a front view of an intake manifold.

FIG. 5 is a rear view of the intake manifold shown in FIG. 4.

FIG. 6 is a cross-sectional view of the intake manifold taken along the line 6—6 in FIG. 4.

FIG. 7 is a cross-sectional view of the intake manifold taken along the line 7—7 in FIG. 4.

FIG. 8 is a plane view of a crankcase which embodies various of the features of the invention.

FIG. 23 is a front view of the manifold mounting surface of the engine.

FIG. 24 is a front view of the intake manifold.

Figure 1:
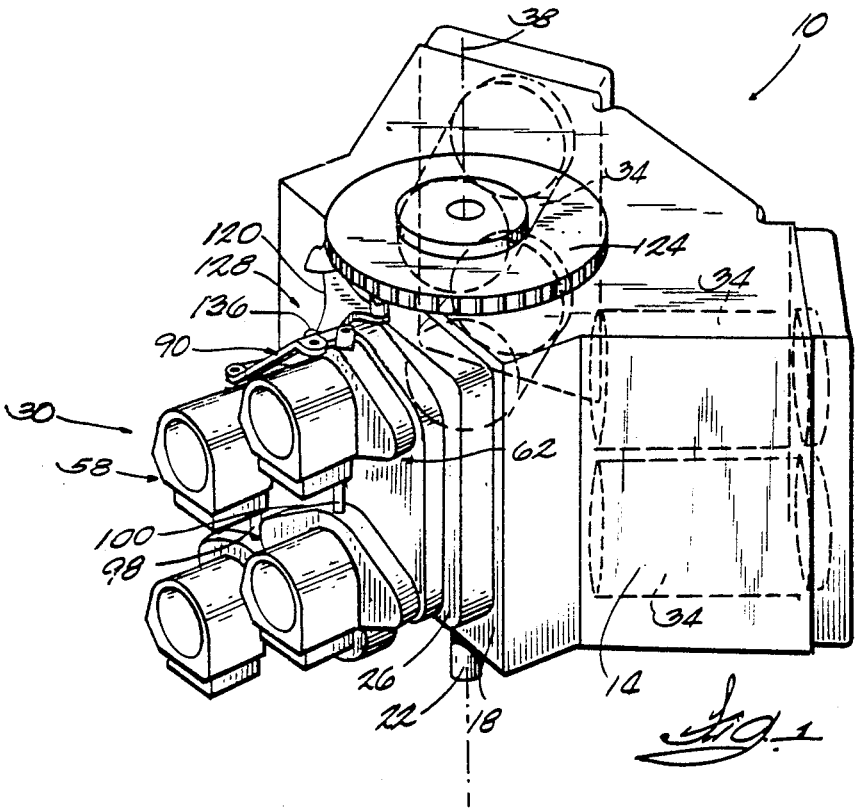
FIG. 1 is a perspective view of a schematic representation of a two-stroke combustion engine which embodies various of the features of the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

As illustrated schematically in FIG. 1, this invention provides an internal combustion engine 10 including an engine block 14, a crankcase 18 attached to the engine block 14, a crankshaft 22 housed in the crankcase 18, a manifold 26 attached to the crankcase 18 and a carburetion system 30 attached to the manifold 26. The internal combustion engine 10 disclosed is a two-stroke engine although the carburetion system 30 described could also be used with appropriate modifications with a four-stroke internal combustion engine. In this embodiment, the engine block 14 includes four combustion cylinders or chambers 34 in a V-shaped arrangement relative to the crankshaft 22, although the invention is also applicable to engines including either more or less combustion chambers and other arrangements.

Air needed for combustion passes from the carburetion system 30 to the respective combustion chambers 34. In order to provide for communication between the carburetion system 30 and the respective combustion chambers 34, non-aligned openings 42 in the crankcase 18 (FIG. 8) determined by the locations of the combustion chambers 34 determine the locations of openings 46 in the rear of the intake manifold 26 (FIG. 5). The openings 50 in the front of the intake manifold 26 (FIG. 4) in turn determine the locations of carburetor assemblies 54 provided for each of the combustion chambers 34.

As illustrated schematically in FIG. 1, and more particularly in FIGS. 2 and 3, the carburetion system 30 comprises a plurality of the carburetor assemblies 54 with each carburetor assembly 54 providing a fuel-air mixture for each of the four combustion chambers 34. The carburetor assemblies 54 consist of a first set 58 of two carburetor assemblies 54 and a second set 62 of two carburetor assemblies 54. In this embodiment, the carburetor assemblies 54 are side draft carburetors although the invention is also applicable to top draft carburetion systems.

As more particularly illustrated in FIGS. 2 and 3, each of the carburetor assemblies 54 includes a carburetor body 66 including a throttle bore or venturi 70, means for introducing fuel into the throttle bore 70 in the form of a float chamber 74 attached to the carburetor body 66, and a throttle body 78 housing a tnrottle shaft portion 82 including a throttle valve 86 disposed within the throttle bore 70. The carburetor body 66 is attached to the throttle body 78. The float chamber 74 and carburetor body 66 can be easily removed from the engine 10 without having to disturb the throttle body 78 or linkage 90 (shown in FIG. 1) provided to rotate the throttle portion 82 to adjust the throttle valve 86, as hereinafter described.

As shown in FIG. 3, the carburetor assemblies 54 in each set 58 or 62 of carburetor assemblies 54 are connected to one another by two generally parallel, spaced-apart extensions 94 between the throttle bodies 78. The carburetor assemblies 54 are not otherwise connected, i.e., the float chambers 74 are not connected to one another and the carburetor bodies 66 are not connected to one another.

The throttle shaft portions 82 are coaxial in each set 58 and 62 of carburetor assemblies. In this embodiment, the throttle shaft portions 82 in set 58 of carburetor assemblies form part of a single throttle shaft 98 and the throttle shaft portions 82 in set 62 of carburetor assemblies form part of a single throttle shaft 100.

The carburetor sets 58 and 62 are connected to the intake manifold 26 shown schematically in FIGS. 1, and more particularly in FIGS. 4, 5 and 6. The carburetors 54 are connected to the intake manifold 26 so that the venture is 70 are disposed over the generally oval shaped openings 50 shown in FIG. 4 on the front of the intake manifold 26 and the throttle shafts 98 and 100 are generally aligned with the crankshaft 22, or parallel to the crankshaft axis of rotation 38, as shown in FIG. 1.

As shown in FIGS. 6 and 7, fuel-air mixture passageways 102 extend from the oval shaped openings 50 on the front of the intake manifold 26 to the generally rectangular openings 46 in the rear of the intake manifold 26. The passageways 102 are in generally parallel relationship, and provide for downward movement of the fuel and air mixture through the intake manifold 26 and improve the effectiveness of the carburetion system 30 by eliminating the need for the fuel-air mixture to flow against gravity. The internal combustion engine 10 also includes reed boxes (not shown) connected to each opening 46 in the rear of the intake manifold 26 when the intake manifold 26 is attached to the crankcase shown in FIG. 7.

Figure 9:
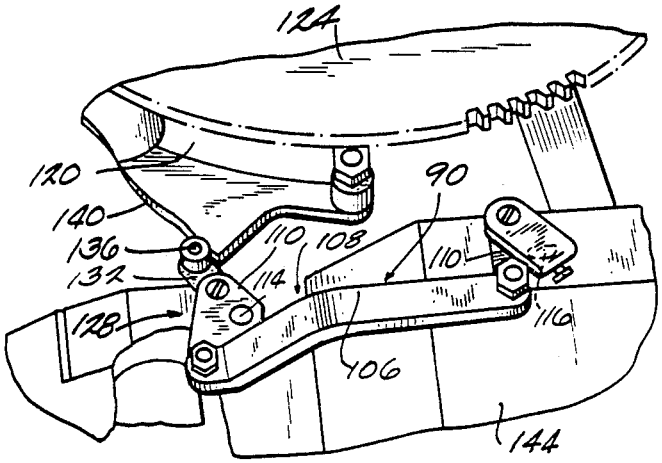
FIG. 9 is an enlarged perspective view of part of the top of the engine shown in FIG. 1.
Figure 10:
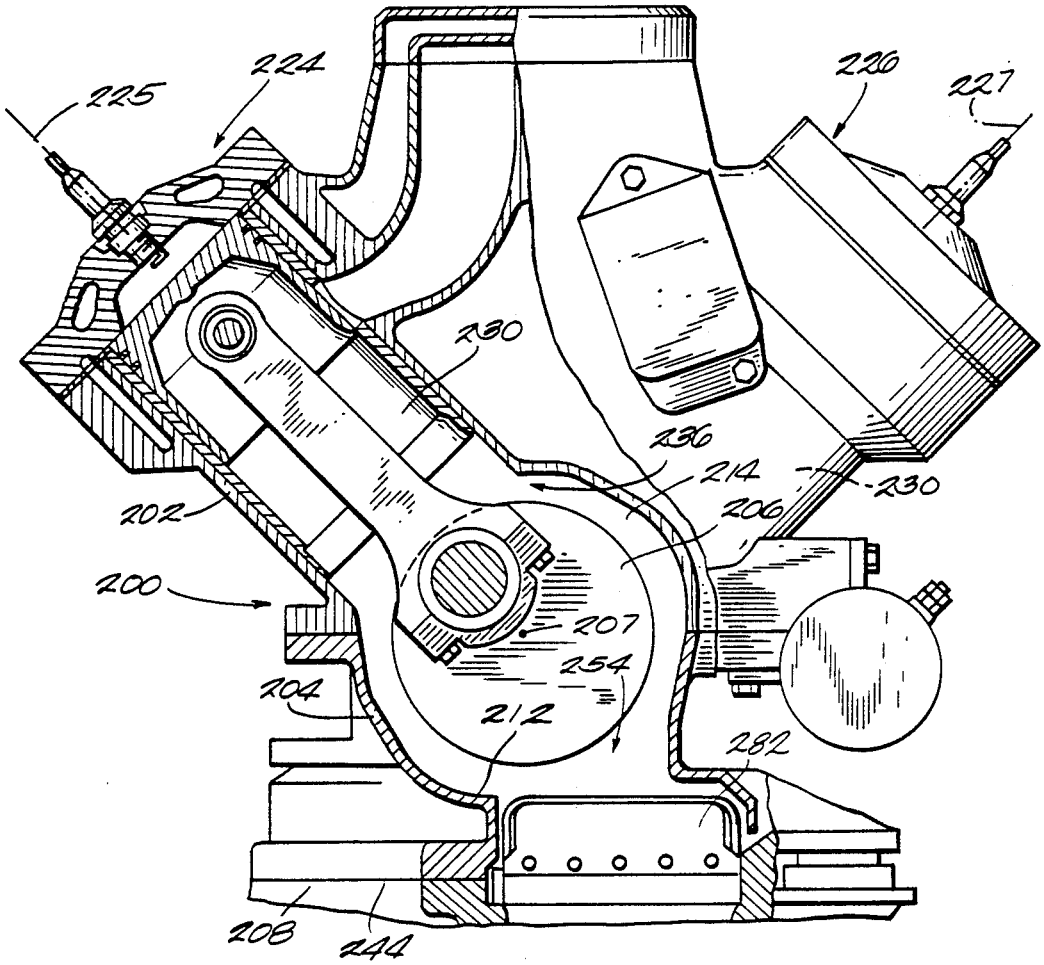
FIG. 10 is a top view, partially cut away, of a two-cycle internal combustion that is the preferred embodiment of the invention.

As shown in FIGS. 1 and 9, connecting means 90 is provided for connecting the tnrottle shaft 98 of the first set 58 of carburetor assemblies to the throttle shaft 100 of the second set 62 of carburetor assemblies so that the first throttle shaft 98 and second throttle shaft 100 have common rotational movement. In this embodiment, the connecting means comprises a bar 106 with an offset 108 and the bar 106 is connected to levers 110 on the ends 114 and 116 of the generally parallel tnrottle shafts 98 and 100, respectively. A cover 144 is shown in FIG. 9 protecting the carburetion system 30.

The amount of adjustment or rotation of the throttle shafts 98 and 100, and the resulting amount of air allowed through the throttle valves 86, is a function of the ignition timing or the crankshaft revolutions per minute. For this reason, a timer base 120 located under a flywheel 124 on the end of the crankshaft 22 is used to control adjustment of the throttle valves 86 in two-stroke engines. In the past, elaborate linkage had to be provided to convert movement of a timer case adjacent an end of a crankshaft into movement of throttle shafts perpendicular to the crankshaft.

This invention provides for simpler means or linkage 128 for connecting the throttle shafts 98 and 100 to the timer case 120 by having the throttle shafts 98 and 100 aligned with the crankshaft 22. With the ends 114 and 116 of the throttle shafts 98 and 100 adjacent the end of the crankshaft 22, the linkage 128 comprises a lever 132 on the end 114 of the throttle shaft 98 which extends to the timer base 120. A roller guide 136 on the lever 132 follows a cam surface 140 on the timer base 120 and serves to rotate the throttle shafts 98 and 100.

The use of the carburetor assemblies 54 for each combustion chamber 34, the pair of parallel throttle shafts 98 and 100 aligned with the crankshaft 22, and generally parallel fuel-air mixture passageways 102 through the intake manifold 26 thus provide for an improved internal combustion engine 10 with an effective and practical carburetion system 30.

An engine 200 which is the preferred embodiment of the invention is illustrated in FIGS. 10 through 24. Like the engine illustrated in FIGS. 1 through 9, the engine 200 comprises an engine block 202, a crankcase 204 attached to the engine block 202, a crankshaft 206 having an axis 207 and being rotatably supported by the crankcase 204, an intake manifold 208 attached to the crankcase 204, and a carburetion system 210 (FIG. 11) attached to the intake manifold 208. Again, while the engine 200 is a two-cycle engine, the carburetion system 210 can be used with appropriate modifications on a four-cycle internal combustion engine.

The crankcase 204 includes a circumferential inner wall 212 partially defining first, second, third, and fourth crankcase chambers 214, 216, 218 and 220, respectively, aligned in the direction of the crankshaft axis 207. The crankcase chambers are also partially defined by respective pairs of annular lands 222 (FIGS. 11 and 14) extending radially inwardly from the inner wall 212 and being spaced apart in the direction of the crankshaft axis 207. Each of the crankcase chambers has a circumference and a depth in the direction of the crankshaft axis 207.

The engine block 202 includes (see FIG. 10) a first or left series or bank 224 of cylinders having parallel longitudinal axes 225 perpendicular to the crankshaft axis 207 and defining a first plane including the crankshaft axis 207, and a second or right series or bank 226 of cylinders 230 having parallel longitudinal axes 227 perpendicular to the crankshaft axis 207 and defining a second plane generally perpendicular to the first plane and including the crankshaft axis 207. It should be understood that in alternative embodiments the first and second series cranks 224 and 226 of cylinders 230 can be at angles other than 90° relative to each other. In the preferred embodiment, the first series 224 of cylinders includes first and third cylinders 230, and the second series 226 of cylinders includes second and fourth cylinders 230. The first, second, third, and fourth cylinders 230 communicate respectively with the first, second, third, and fourth crankcase chambers 214, 216, 218 and 220 through respective first, second, third, and fourth cylinder openings 236 (FIGS. 10 and 12-15) in the crankcase 204.

The crankcase 204 also includes a generally flat manifold mounting surface 244 (FIGS. 10, 11 and 23) generally perpendicular to a plane bisecting the first and second planes of the first and second cylinder banks 224 and 226. As best shown in FIG. 23, the manifold mounting surface 244 includes a first series 248 of inlet openings 246 aligned in the direction of the crankshaft axis 207, and a second series 250 of inlet openings 246 aligned in the direction of the crankshaft axis 207. In the preferred embodiment, the first and second series of inlet openings are laterally offset with respect to the direction of the crankshaft axis 207, as shown in FIG. 23. Also, in the preferred embodiment, the inlet openings 246 are in alternating offset relation, so that the first series 248 includes first and third inlet openings 246 and the second series 250 includes second and fourth inlet openings 246. This increases the space available for each carburetor, as will become apparent upon reading the following description of the intake manifold 208 and of the carburetor system 210. Preferably, each inlet opening 246 has a minor dimension parallel to the crankshaft axis 207, a major dimension transverse to the crankshaft axis 207, and a portion overlapping the inlet openings 246 of the other of the first and second series. Overlapping the inlet openings 246 allows sufficient space for the carburetors while limiting the width of manifold mounting surface 244 and thus the width of the intake manifold 208.

Figure 11:
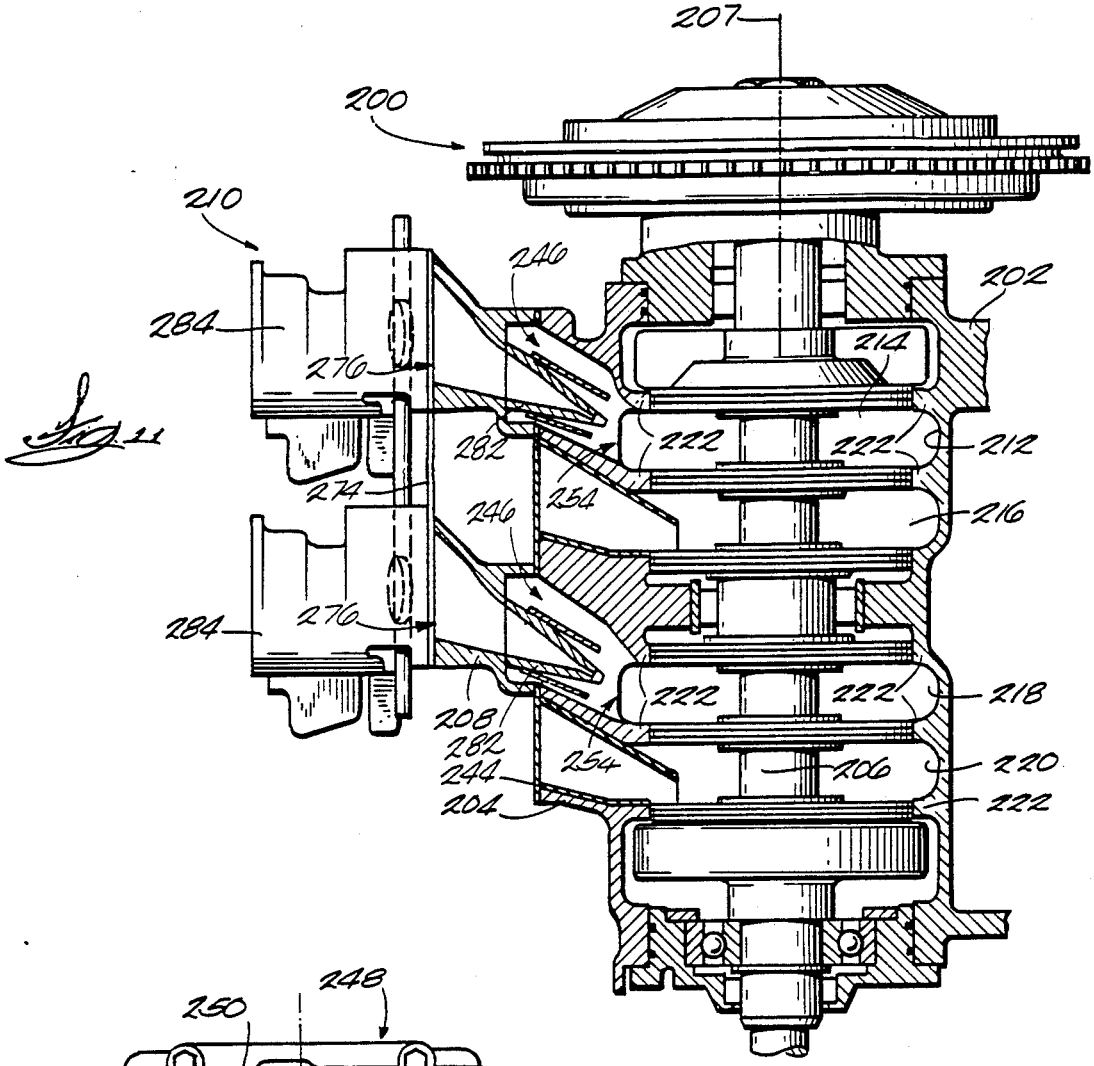
FIG. 11 is a vertical cross-sectional view of the engine shown in FIG. 10.
Figure 13:
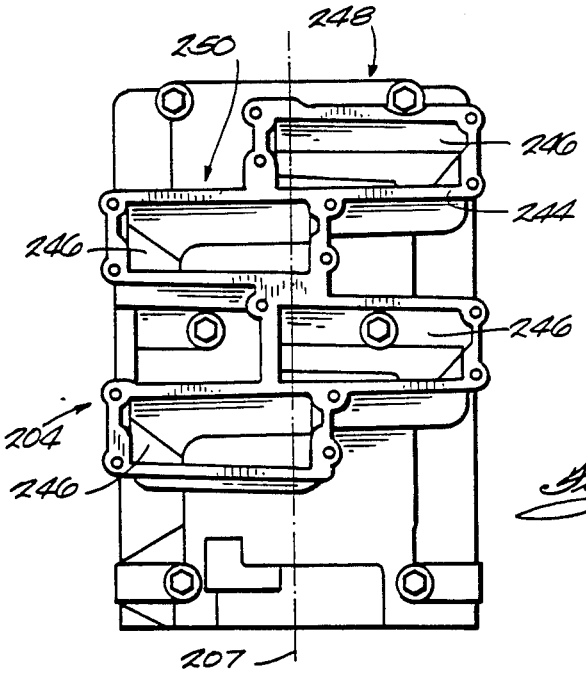
FIG. 13 is a horizontal cross-sectional view through one of the cylinders of the right bank and through the associated crankcase chamber.
Figure 13:
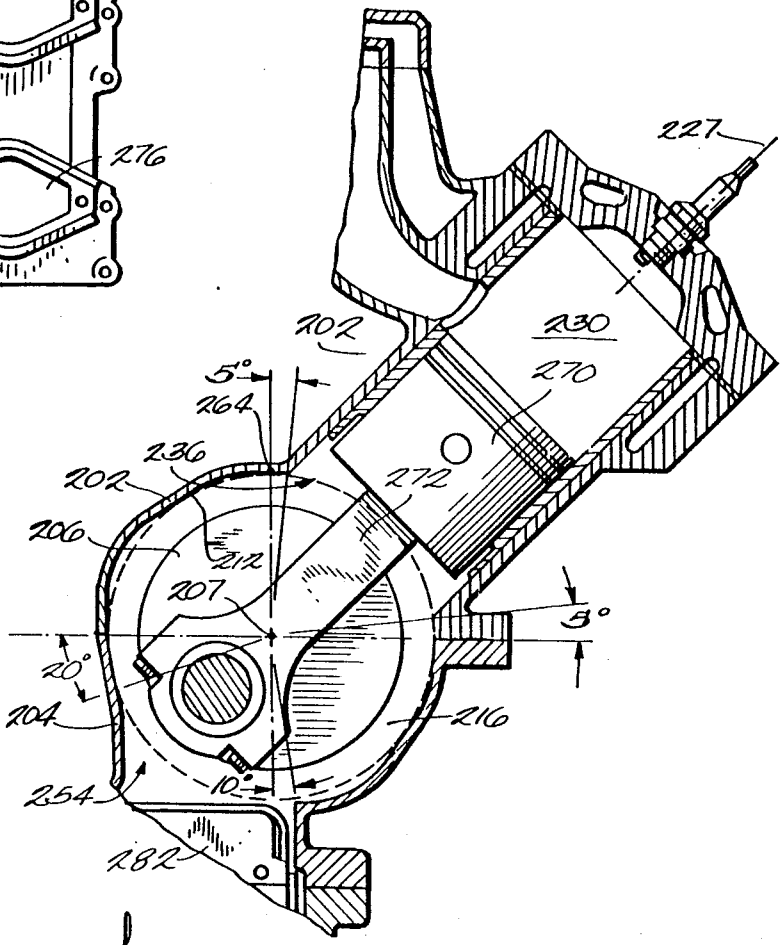
Figure 12:
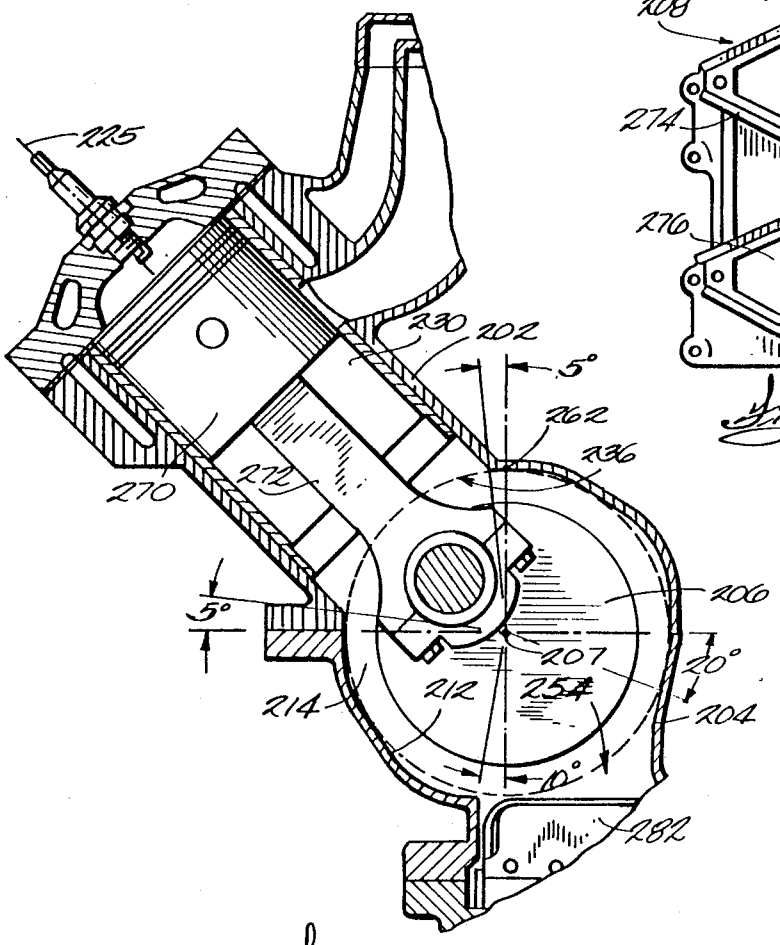
FIG. 12 is a horizontal cross-sectional view through one of the cylinders of the left bank (as viewed in FIG. 10) and through the associated crankcase chamber.
Figure 15:
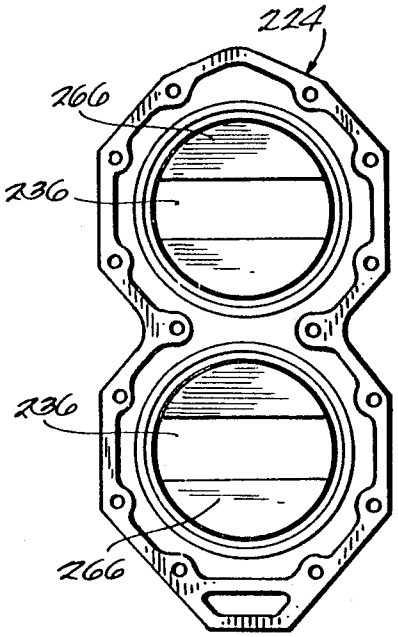
FIG. 15 is a cross-sectional view taken along lines 15—15 in FIG. 14.
Figure 14:
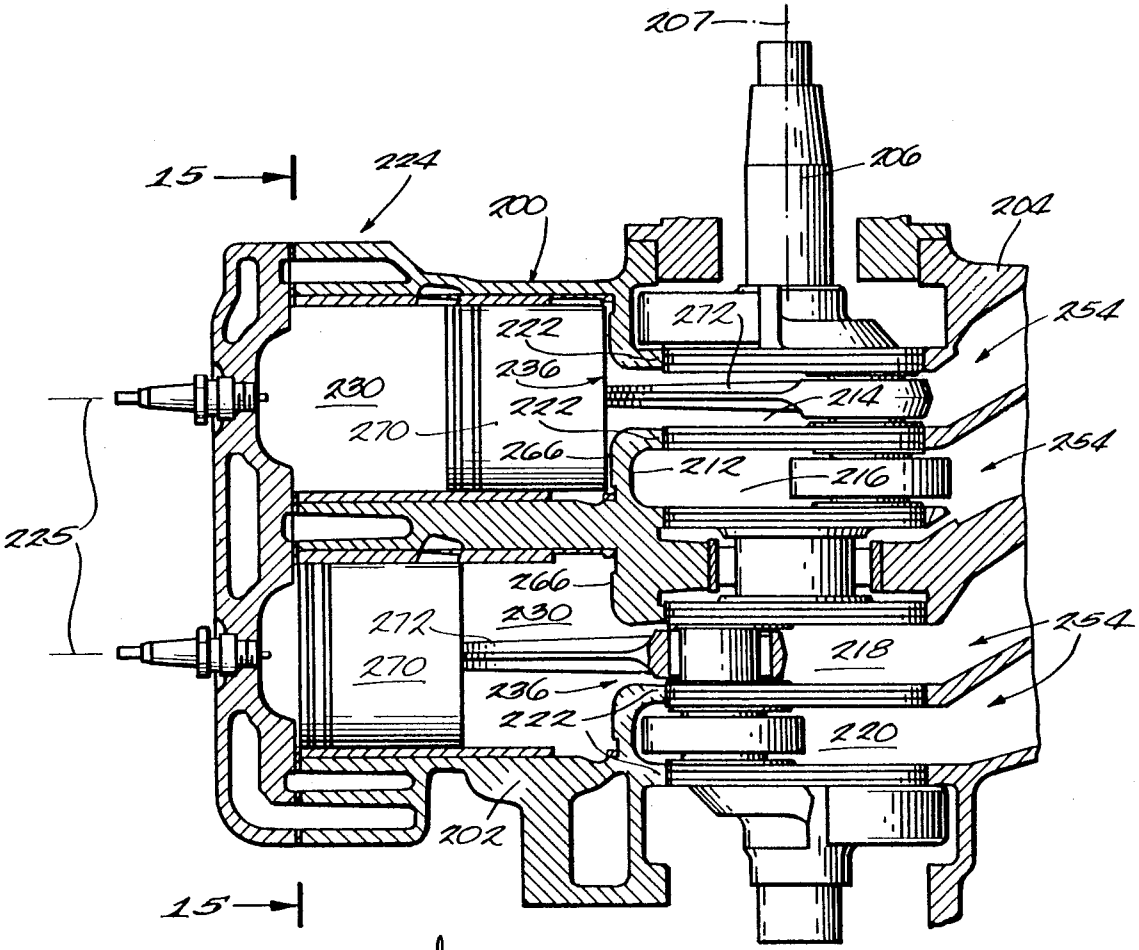
Figure 18:
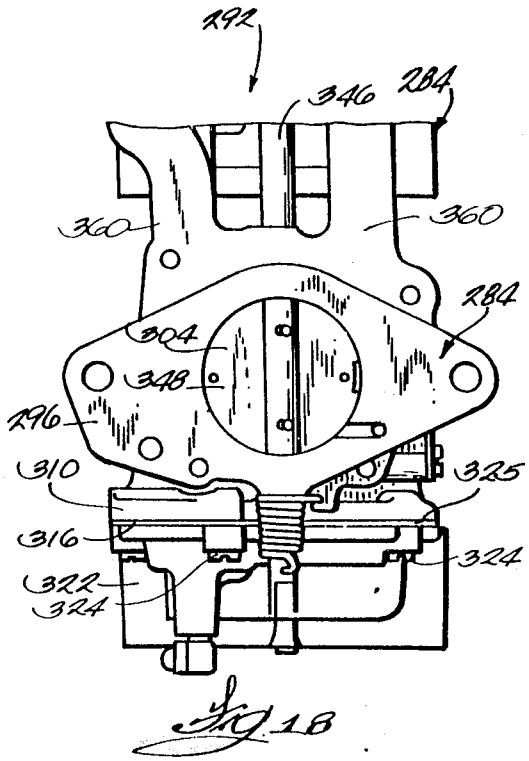
FIG. 18 is a rear view of the carburetor shown in FIG. 17.

The first, second, third, and fourth inlet openings 246 communicate respectively with the first, second, third, and fourth crankcase chambers 214, 216, 218 and 220 through respective first, second, third, and fourth entry openings 254 (FIGS. 10 through 14) in the crankcase 204 located in respectively generally diametrically opposite relation to the first, second, third, and fourth cylinder openings 236 in the crankcase 204, as best shown in FIGS. 12 and 13. Having the entry openings 254 generally diametrically opposite the cylinder openings 236 provides maximum engine power by maximizing air flow to the cylinders 230. The air flow is maximized because air coming into the crankcase does not have to turn a corner to enter a cylinder.

Because the first and third cylinders are substantially identical and the second and fourth cylinders 230 are substantially identical, only the first and second cylinders 230 and their respective crankcase chambers 214 and 216 will be described in detail.

As best shown in FIG. 12, the first cylinder opening 236 extends on the circumference of the first crankcase chamber 214 between approximately 5° to approximately 85° in one circumferential direction (counterclockwise in FIG. 12) from a first point 262 on the circumference of the first crankcase chamber 214 and on the plane bisecting the first and second cylinder banks 224 and 226. The first entry opening 254 extends on the circumference of the first crankcase chamber 214 between approximately 170° to approximately 250° in the counterclockwise direction from the first point 262.

As best shown in FIG. 13, the second cylinder opening 236 extends on the circumference of the second crankcase chamber 216 between approximately 5° to approximately 85° in the other circumferential direction (clockwise in FIG. 13) from a second point 264 on the circumference of the second crankcase and on the plane bisecting the cylinder banks 224 and 226. The second entry opening 254 extends on the circumference of the second crankcase chamber 216 between approximately 170° to approximately 250° in the clockwise direction from the second point 264. The first entry opening 254 and the first cylinder opening 236 each have a depth substantially equal to the depth of the first crankcase chamber 214, and the second entry opening 254 and the second cylinder opening 236 each have a depth substantially equal to the depth of the second crankcase chamber 216.

Additionally, the first cylinder longitudinal axis 225 extends at an angle of approximately 45° in the counterclockwise direction with respect to the above-mentioned plane bisecting the cylinder banks 224 and 226, and the crankcase 204 includes a first end wall surface 266 (FIGS. 14 and 15) perpendicular to the first cylinder longitudinal axis 225 and defining an end of the first cylinder 230. The first end wall surface 266 has therein the first cylinder opening 236. Furthermore, the second cylinder longitudinal axis 227 extends at an angle of approximately 45° in the clockwise direction with respect to the above-mentioned plane, and the crankcase 204 includes (see FIG. 14) a second end wall surface 266 perpendicular to the second cylinder longitudinal axis 227 and defining an end of the second cylinder 230. The second end wall surface 266 has therein the second cylinder opening 236.

In the preferred embodiment, the first cylinder 230 has a diameter greater than the depth of the first opening 236, and the second cylinder 230 has a diameter greater than the depth of the second opening 236, so that the first and second cylinder openings 236 actually define respective slots (see FIG. 15) in the first and second end wall surfaces 266.

Figure 14:
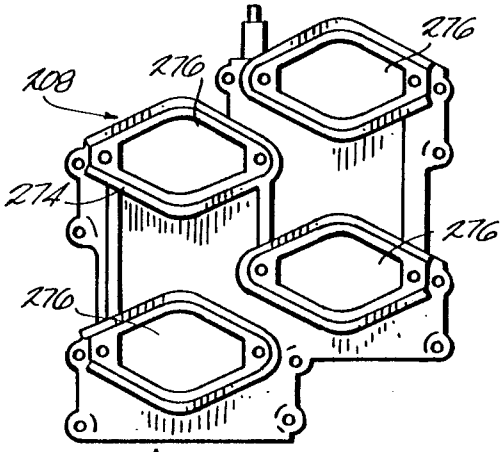
FIG. 14 is a generally vertical cross-sectional view through the left bank of cylinders.

As best shown in FIGS. 12 through 14, each of the cylinders slideably receives a piston 270 pivotally connected to the upper end of a piston rod 272 having a lower end pivotally connected to the crankshaft 206. As best shown in FIGS. 12 and 13, the inner wall 212 extends closely adjacent to the path of travel of the lower ends of the piston rods 272. Therefore, the crankcase chambers defined by the inner wall 212 are not exactly cylindrical. This can be best appreciated by noting the dotted lines in FIGS. 12 and 13 running just inside or along the inner wall 212. These dotted lines are circles centered on the crankshaft axis 207.

The intake manifold 208 of the preferred embodiment is substantially identical to the intake manifold 26 illustrated in FIGS. 4 through 7. In the preferred embodiment, the intake manifold 208 is mounted on the manifold mounting surface 244 and includes a generally flat carburetor mounting surface 274 (FIGS. 11 and 24) having therein first, second, third, and fourth intake openings 276 communicating respectively with the first, second, third and fourth inlet openings 246 in the manifold mounting surface 244. As best shown in FIG. 4, the intake openings 276 are arranged in a pattern substantially identical to the pattern of the inlet openings 246. The intake manifold also includes conventional reed boxes 282 (FIGS. 10-13) mounted in the intake openings 276 and extending into the inlet openings 246 of the crankcase 204.

As best shown in FIG. 11, the carburetion system 210 includes first, second, third, and fourth carburetors 284 (only two carburetors 284 are shown in FIG. 11) communicating respectively with the first, second, third, and fourth intake openings 276 in the carburetor mounting surface 274. As in the embodiment illustrated in FIGS. 1 through 9, the carburetion system 210 includes a first set 292 (FIGS. 16–18) of carburetors including the first and third carburetors 284, and a second set (not shown) of carburetors including the second and fourth carburetors 284. Also, as in the embodiment illustrated in FIGS. 1 through 9, the carburetors 284 of the preferred embodiment are side-draft carburetors, although the invention is also applicable to top-draft carburetors.

Since the carburetors 284 are substantially identical, only one carburetor 284 will be described in detail.

Figure 17:
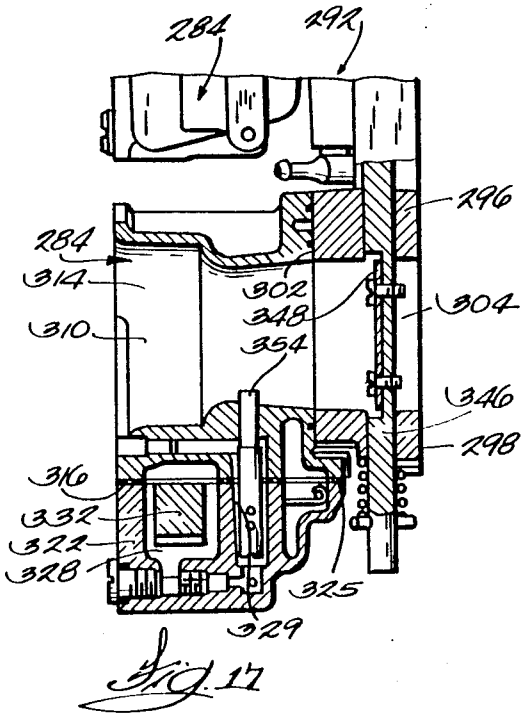
FIG. 17 is a cross-sectional view taken along line 17—17 in FIG. 16.

As best shown in FIGS. 16 through 22, the carburetor 284 includes a throttle body section 296 having a first or right end 298 (as shown in FIG. 17), an opposite second or left end including a generally flat mounting surface 302 (FIG. 17), and a first portion 304 of an air passage extending between the right end 298 and the mounting surface 302. In the preferred embodiment, the throttle body section 296 also includes a fuel chamber 306 (FIG. 20) communicating with the air passage first portion 304 via a pair of secondary openings 308. Preferably, the throttle body section 296 is made of metal, although it can also be made of plastic.

Figure 16:
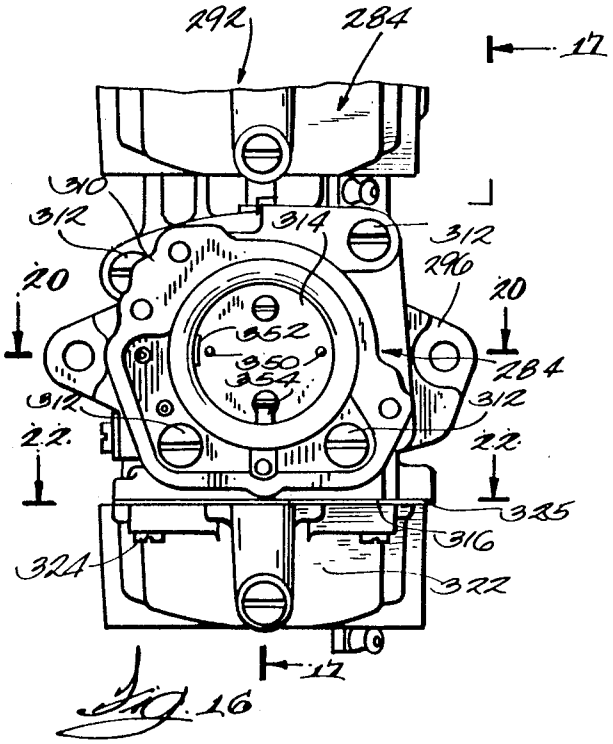
FIG. 16 is a front view of a carburetor of the engine.
Figure 19:
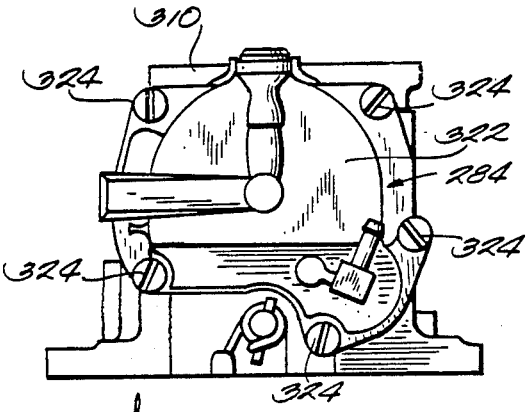
FIG. 19 is a bottom view of the carburetor shown in FIG. 16.
Figure 20:
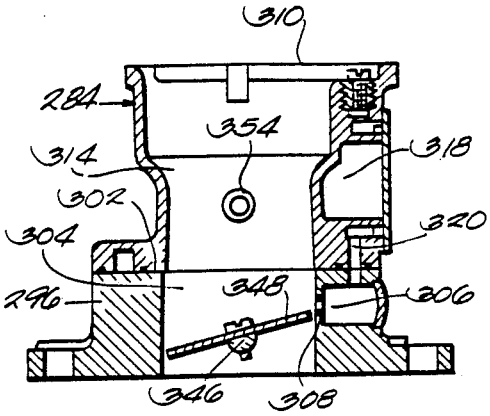
FIG. 20 is a cross-sectional view taken along line 20—20 in FIG. 16.

The carburetor 284 also includes a venturi section 310 mounted on the mounting surface 302 of the throttle body section 296 by a plurality of bolts 312 (FIG. 16). The venturi section 310 includes a second portion 314 of the air passage, and a generally flat mounting surface 316 (FIGS. 16–18) transverse to the mounting surface 302 of the throttle body section 296, as best shown in FIG. 17. In the illustrated construction, the mounting surface 316 of the venturi section 310 is generally horizontal and faces downwardly. Preferably, the venturi section 310 also includes a fuel chamber 318 (FIG. 20) communicating with the tnrottle body section fuel chamber 306 via a fuel passage 320.

Figure 21:
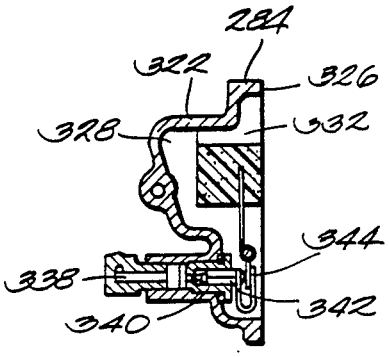
FIG. 21 is a cross-sectional view taken along line 21—21 in FIG. 22.
Figure 22:
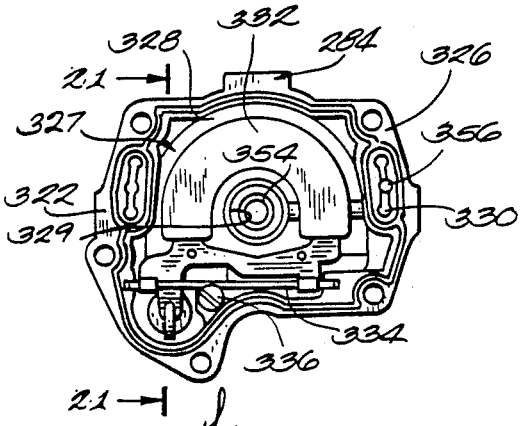
FIG. 22 is a cross-sectional view taken along line 22—22 in FIG. 16.

The carburetor 284 further includes a float bowl section 322 mounted on the mounting surface 316 of the venturi section 310 by a plurality of bolts 324 (FIGS. 16 through 19). Preferably, a gasket 325 (FIGS. 16–18) separates the float bowl section 322 and the venturi section 310. In the preferred embodiment, the float bowl section 322 is generally cup-shaped and has an upper end forming a generally flat surface 326 (FIGS. 21 and 22) abutting the mounting surface 316 (actually the gasket 325) of the venturi section 310. As best shown in FIGS. 21 and 22, the float bowl section 322 includes a reservoir 327 (FIG. 22) including a float chamber 328, a well 329 communicating with the float chamber 328, and a well 330 (FIG. 22) communicating with the float chamber 328. The float bowl section 322 also includes a conventional float 332 mounted in the float chamber 328 for pivotal movement about a rod 334 (FIG. 22) which is secured to the float bowl section 322 by a screw 336. As best shown in FIG. 21, the float bowl section 322 further includes a fuel inlet passage 338 adapted to be connected to a source of fuel (not shown), a valve seat member 340 threaded into the fuel inlet passage 338 and forming a valve seat, and a valve member 342 connected to an arm 344 extending from the float 332 for movement into and out of engagement with the valve seat in response to movement of the float 332. As is known in the art, when sufficient fuel is present in the float chamber 328, the float 332 is buoyed by the fuel and causes the valve member 342 to move into engagement with the valve seat, thereby closing the fuel inlet passage 338. As fuel flows out of the float chamber 328, the float 332 moves downwardly (to the left in FIG. 21) and causes the valve member 342 to move out of engagement with the valve seat, thereby opening the fuel inlet passage 338 and allowing more fuel to enter the float chamber 328.

Preferably, onto the venturi section 310 and the float bowl section 322 are made of plastic.

The carburetor 284 further includes a throttle shaft 346 (FIGS. 17, 18 and 20) rotatably mounted in the throttle body section 296 and extending through the air passage first portion 304, and a throttle plate 348 mounted on the throttle shaft 346 in the air passage first portion 304. As best shown in FIG. 16, the throttle plate 348 has therein a pair of openings 350 which allow air flow through the tnrottle plate 348 even when the throttle plate 348 is in the closed position, and a cut-out portion 352 allowing air flow past the secondary openings 308 when the throttle plate 348 is in the closed position.

The carburetor 284 further includes conduit means or a nozzle 354 (FIGS. 16, 17, 20 and 22) mounted in the venturi section 322 and communicating between the air passage second portion 314 and the reservoir 327. More specifically, the nozzle 354 preferably communicates with the well 329. In the preferred embodiment, as best shown in FIG. 17, the nozzle 354 extends generally vertically and has a first or upper end extending into and communicating with the air passage second portion 314, and a second or lower end extending beyond or beneath the mounting surface 316 of the venturi section 310 into the well 329.

In the preferred embodiment, the carburetor 284 further includes a conduit 356 (FIG. 22) communicating between the venturi section fuel chamber 318 and the reservoir 327. More specifically, the conduit 356 preferably communicates with the well 330. Thus, fuel flows from the float chamber 328 to the air passage first portion 304 via the well 330, the conduit 356, the venturi section fuel chamber 318, the fuel passage 320, the throttle body section fuel chamber 306, and the secondary openings 308.

As in the embodiment illustrated in FIGS. 1 through 9, the two carburetors 284 of each set are connected to one another by portions 360 extending between the respective tnrottle body sections 296. Also, as in the embodiment illustrated in FIGS. 1 through 9, a single throttle shaft 346 extends through the first and third carburetors 284, and a single throttle shaft (not shown) extends through the second and fourth carburetors 284.

Various other features and advantages of the invention are set forth in the following claims.

We claim:

1. An internal combustion engine comprising a crankcase adapted to rotatably support a crankshaft having an axis, said crankcase defining a plurality of crankcase chambers and including a generally flat manifold mounting surface including a therein a first series of inlet openings aligned in the direction of the crankshaft axis, and a second series of inlet openings aligned in the direction of the crankshaft axis, said first and second series of inlet openings being laterally offset with respect to the direction of the crankshaft axis, and said inlet openings of said first and second series each being respectively adapted to feed air to one of said crankcase chambers and each having a minor dimension parallel to the crankshaft axis, and a major dimension transverse to the crankshaft axis, said inlet openings in said first series each having a portion overlapping said inlet openings of said second series and said inlet openings in said second series each having a portion overlapping said inlet openings of said first series.

2. An internal combustion engine comprising a crankcase adapted to rotatably support a crankshaft having an axis, said crankcase defining first and second generally cylindrical crankcase chambers aligned in the direction of the crankshaft axis, a first cylinder having a longitudinal axis intersecting the crankshaft axis, a second cylinder having a longitudinal axis at a substantial angle to said first cylinder axis and intersecting the crankshaft axis, said first and second cylinders respectively communicating with said first and second crankcase chambers through respective first and second cylinder openings in said crankcase, and a generally flat manifold mounting surface generally perpendicular to a line bisecting said first and second axes, said mounting surface including first and second inlet openings respectively communicating with said first and second crankcase chambers through respective entry openings in said crankcase located in respectively generally diametrically opposite and spaced relation to said first and second cylinder openings.

3. An internal combustion engine comprising a crankcase adapted to rotatably support a crankshaft having an axis, said crankcase defining a first generally cylindrical crankcase chamber having a circumference, and a second crankcase chamber aligned in the direction of the crankshaft axis and having a circumference, a first cylinder having a longitudinal axis perpendicularly intersecting the crankshaft axis and a first end wall surface perpendicular to said firs cylinder longitudinal axis and defining an end wall of said first cylinder, said first cylinder communicating with said first crankcase chamber through a first cylinder opening located in said first end wall and on the circumference of said first crankcase chamber between approximately 5° to approximately 85° in one circumferential direction from a point located on the circumference of said first crankcase chamber and in a plane which is perpendicular to the crankshaft axis, a second cylinder having a longitudinal axis perpendicular intersecting the crankshaft axis at a 90° angle to said first cylinder axis and a second end wall surface perpendicular to said second cylinder longitudinal axis and defining an end wall of said second cylinder, said second cylinder communicating with said second crankcase chamber through a second cylinder opening located in said second cylinder end wall and on the circumference of said second crankcase chamber between approximately 5° to approximately 85° in the other circumferential direction from a point on the circumference of said second crankcase chamber and in a plane which is perpendicular to the crankshaft axis, and a generally flat manifold mounting surface extending generally perpendicularly to a plane bisecting said 90° angle between said longitudinal axes of said first and second cylinders and containing the crankshaft axis and said points on the circumference to said first and second cylinders, said mounting surface including a first inlet opening communicating with said first crankcase chamber through a first entry opening located on said circumference to said first crankcase chamber and in generally diametrically opposite and spaced relation to said first cylinder opening and between approximately 170° to approximately 250° in said one circumferential direction from said point located on said circumference of said first crankcase chamber, said mounting surface also including a second inlet opening communicating with said second crankcase chamber through a second entry opening located on said circumference of said second crankcase chamber and in diametrically opposite relation to said second cylinder opening and between approximately 170° to approximately 250° in the other circumferential direction from said point located on said circumferential of said second crankcase chamber, said first and second inlet openings being laterally offset with respect to the direction of the crankshaft axis and extending at least in partially overlapping relation to each other in the direction transverse to the crankshaft axis, each of said first and second inlet openings having a minor dimension parallel to the crankshaft axis, and a major dimension transverse to the crankshaft axis.

4. An internal combustion engine as set forth in claim 3 wherein said crankcase includes a circumferential inner wall partially defining said first and second crankcase chambers, wherein said first crankcase chamber is partially defined by a first pair of annular lands extending radially inwardly from said inner wall and being spaced apart in the direction of the crankshaft axis, and wherein said second crankcase chamber is partially defined by a second pair of annular lands extending radially inwardly from said inner wall and being spaced apart in the direction of the crankshaft axis.

5. An internal, combustion engine as set forth in claim 3 wherein said first crankcase chamber has a depth in the direction of the crankshaft axis, wherein said first entry opening and said first cylinder opening each nave a depth substantially equal to the depth of said first crankcase chamber, wherein said second crankcase chamber has a depth in the direction of the crankshaft axis, and wherein said second entry opening and said second cylinder opening each have a depth substantially equal to the depth of said second crankcase chamber.

6. An internal combustion engine as set forth in claim 5 wherein said first cylinder has a diameter greater than the depth of said first opening, and wherein said second cylinder has a diameter greater than the depth of said second opening.

7. An internal combustion engine as set forth in claim 3 wherein said first and second cylinders are each adapted to slideably receive a piston pivotally connected to the upper end of a piston rod having a lower end pivotally connected to the crankshaft, and wherein said crankcase includes a circumferential inner wall partially defining said first and second crankcase chambers and extending closely adjacent to the path of travel of the lower end of the associated piston rod.

8. An internal combustion engine comprising a crankcase adapted to rotatably support a crankshaft having an axis, said crankcase and defining a plurality of generally cylindrical crankcase chambers aligned in the direction of the crankshaft axis, a first series of cylinders having parallel longitudinal axes defining a first plane including the crankshaft axis, a second series of cylinders having parallel longitudinal axes defining a second plane at a substantial angle to said first plane and including the crankshaft axis, each of said cylinders of said first and second series communicating with an associated crankcase chamber through a cylinder opening in said crankcase, and a generally flat manifold mounting surface generally perpendicular to a plane bisecting said first and second planes, said mounting surface including a plurality of inlet openings respectively communicating with said crankcase chambers through respective entry openings in said crankcase located in respectively generally diametrically opposite and spaced relation to said cylinder openings.

9. An internal combustion engine comprising a crankcase adapted to rotatably support a crankshaft having an axis, said crankcase defining a plurality of generally cylindrical crankcase chambers aligned in the direction of the crankshaft axis, a first series of cylinders having parallel longitudinal axes defining a first plane including the crankshaft axis, a second series of cylinders having parallel longitudinal axes defining a second plane at a substantial angle to said first plane and including the crankshaft axis, each of said cylinders of said first and second series communicating with an associated crankcase chamber through a cylinder opening in said crankcase, a generally flat manifold mounting surface generally perpendicular to a plane bisecting said first and second planes, said mounting surface including a plurality of inlet openings respectively communicating with said crankcase chambers through respective entry openings in said crankcase located in respectively generally diametrically opposite and spaced relation to said cylinder openings, an intake manifold mounted on said manifold mounting surface and including a generally flat carburetor mounting surface having therein a plurality of intake openings respectively communicating with said inlet openings, and a plurality of carburetors respectively communicating with said intake openings and each including a throttle body section mounted on said carburetor mounting surface and having a first end including a flat surface abutting said carburetor mounting surface, an opposite second end including a generally flat mounting surface, and a first portion of an air passage extending between said first end surface and said second end mounting surface and communicating with an associated intake opening, a venturi section mounted on said mounting surface of said throttle body section and including a second portion of said air passage, and a generally flat mounting surface transverse to said mounting surface of said throttle body section, a float bowl section mounted on said mounting surface of said venturi section and including a generally flat surface abutting said mounting surface of said venturi section, and a reservoir including a float chamber, a throttle shaft rotatably mounted in said tnrottle body section and extending through said first air passage portion, a throttle plate mounted on said throttle shaft in said first air passage portion, and conduit means communicating between said second air passage portion and said reservoir.

10. An internal combustion engine as set forth in claim 9 wherein said mounting surface of said venturi section is generally horizontal and faces downwardly, wherein said float bowl section is generally cup-shaped and has an upper end forming said generally flat surface of said float bowl section, and wherein said conduit means extends generally vertically between said reservoir and said air passage second portion.

11. An internal combustion engine as set forth in claim 9 wherein said throttle body section is made of metal, and wherein said venturi section and said float bowl section are made of plastic.

12. An internal combustion engine as set forth in claim 9 wherein said throttle body section, said venturi section and said float bowl section are made of plastic.

13. An internal combustion engine as set forth in claim 9 wherein said reservoir further includes a well communicating with said float chamber, and wherein said carburetor further comprises a conduit communicating between said air passage first portion and said well.

14. An internal combustion engine as set forth in claim 9 wherein said conduit means includes a nozzle mounted in said venturi section and having a first end communicating with said air passage second portion, and a second end extending beyond said mounting surface of said venturi section into said reservoir.

15. An internal combustion engine comprising a crankcase adapted to rotatably support a crankshaft having an axis, said crankcase including a generally flat manifold mounting surface including therein a first series of inlet openings aligned in the direction of the crankshaft axis and a second series of inlet openings aligned in the direction of the crankshaft axis, said inlet openings of said first and second series being in alternating laterally offset relation with respect to each other in the direction of the crankshaft axis, and said inlet openings being adapted to feed air to said crankcase and each having a minor dimension parallel to the crankshaft axis and a major dimension transverse to the crankshaft axis.

16. An internal combustion engine in accordance with claim 15 wherein said first series of inlet openings comprises two inlet openings and wherein said second series of inlet openings comprises two inlet openings.

17. An internal combustion engine in accordance with claim 16 wherein said crankcase inlet openings define a crankcase inlet opening pattern, and wherein said engine further includes a manifold mounted on said crankcase and including passages respectively communicating with each of said crankcase inlet openings, said passages extending in parallel relation to one another and each including an outlet opening and an entrance opening, said outlet openings defining a manifold outlet opening pattern substantially the same as said crankcase inlet opening pattern, and said entrance openings defining a manifold entrance opening pattern similar to said manifold outlet opening pattern.

18. An intake manifold adapted to be connected to a crankcase adapted to rotatably a support a crankshaft having an axis, said intake manifold comprising a first intake passage, and a second intake passage spaced from said first intake passage in the direction of the crankshaft axis and in laterally offset relation with respect to the direction of the crankshaft axis, said first and second intake passages being adapted to feed air to the crankcase, extending in substantially parallel relation to each other, and each including an outlet having a minor dimension parallel to the crankshaft axis and a major dimension transverse to the crankshaft axis.

19. An intake manifold adapted to be connected to a crankcase adapted to rotatably support a crankshaft having an axis, said intake manifold comprising a first series of intake passages aligned in the direction of the crankshaft axis, and a second series of intake passages aligned in the direction of the crankshaft axis, said intake passages of said first and second series being in alternating laterally offset relation with respect to each other in the direction of the crankshaft axis, said passages of said first and second series extending in substantially parallel relation to one another, and each including an outlet having a minor dimension parallel to the crankshaft axis and a major dimension transverse to the crankshaft axis and being adapted to feed air to the crankcase.

20. An air inlet manifold in accordance with claim 19 wherein said first series of passages includes first and second passages spaced from each other in the direction of the crankshaft axis, and wherein said second series of passages includes third and fourth passages spaced from each other in the direction of the crankshaft axis, said third passage being located, in the direction of the crankshaft axis, between said first and second passages, and said fourth passage being located, in the direction of the crankshaft axis, beyond said second passage.

21. An air inlet manifold in accordance with claim 20 wherein said first, second, third and fourth passages are equally spaced from the adjacent of said passages in the direction of the crankshaft axis.

22. An internal combustion engine including first and second cylinders, a crankshaft, a crankcase connected to said first and second cylinders, rotatably supporting said crankshaft, and including first and second inlet openings aligned in the direction of said crankshaft, a throttle body housing member fixed to said crankcase and including spaced first and second throttle body openings communicating with said first and second inlet openings, a first carburetor body attached to said throttle body housing member, a second carburetor body attached to said throttle body housing, a throttle shaft rotatably mounted by said throttle body housing member and having a first portion located in said first throttle body opening and a second portion located in said second throttle body opening, and first and second throttle valves mounted respectively on said first and second portions of said throttle shaft.

23. An internal combustion engine comprising a crankcase adapted to rotatably support a crankshaft having an axis, said crankcase including a generally flat manifold mounting surface including therein a first series of inlet openings aligned in the direction of the crankshaft axis, and a second series of inlet openings aligned in the direction of the crankshaft axis and in laterally offset relation to said first series of inlet openings, an intake manifold including a generally flat crankcase mounting surface connected to said mounting surface of said crankcase, a generally flat carburetor mounting surface extending in spaced generally parallel relation to said crankcase mounting surface, a first series of passages extending between said crankcase and carburetor mounting surfaces and respectively communicating with said first series of inlet openings and a second series of passages extending between said crankcase and carburetor mounting surfaces and respectively communicating with said second series of inlet openings, a first throttle body housing member fixed to said carburetor mounting surface and including a first series of throttle body openings respectively communicating with said first series of passages, a first series of carburetor bodies attached to said first throttle body housing member and respectively communicating with said first series of throttle body openings, a first throttle shaft rotatably mounted by said first throttle body housing member and having a first series of portions respectively located in said first series of throttle body openings, a second throttle body housing member fixed to said carburetor mounting surface and including a second series of throttle body openings respectively communicating with said second series of passages, a second series of carburetor bodies attached to said second throttle body housing member and respectively communicating with said second series of throttle body openings, and a second throttle shaft rotatably mounted by said second throttle body housing member and having a second series of portions respectively located in said second series of throttle body openings.

24. An intake manifold adapted to be connected to a crankcase adapted to rotatably support a crankshaft having an axis, said intake manifold comprising a first series of intake passages aligned in the direction of the crankshaft axis, and a second series of intake passages aligned in the direction of the crankshaft axis, said intake passages of si first and second series being spaced in relation to one another in the direction of the crankshaft axis and in alternating laterally offset relation with respect to each other in the direction of the crankshaft axis, said passages of said first and second series extending in substantially parallel relation to one another, and each including an outlet having a minor dimension parallel to the crankshaft axis and a major dimension transverse to the crankshaft axis and being adapted to feed air to the crankcase.

25. An air inlet manifold in accordance with claim 24 wherein said firs series of passages includes first and second passages spaced from each other in the direction of the crankshaft axis, and wherein said second series of passages includes third and fourth passages spaced from each other in the direction of the crankshaft axis, said third passage being located, in the direction of the crankshaft axis, between said first and second passages, and said fourth passage being located, in the direction of the crankshaft axis, beyond said second passage.

26. An air inlet manifold in accordance with claim 25 wherein said first, second, third and fourth passages are equally spaced from the adjacent of said passages in the direction of the crankshaft axis.

* * * * *